US006873232B2

(12) United States Patent
Chida et al.

(10) Patent No.: US 6,873,232 B2
(45) Date of Patent: Mar. 29, 2005

(54) MINIATURIZABLE ELECTROMAGNETIC RELAY

(75) Inventors: Yoshifumi Chida, Iwate (JP); Kei Chiba, Iwate (JP)

(73) Assignees: NEC TOKIN Corporation, Sendai (JP); NEC TOKIN Iwate, Ltd., Ichinoseki (JP)

( * ) Notice: Subject to any disclaimer, the term of this patent is extended or adjusted under 35 U.S.C. 154(b) by 0 days.

(21) Appl. No.: 10/920,067

(22) Filed: Aug. 17, 2004

(65) Prior Publication Data

US 2005/0046527 A1 Mar. 3, 2005

(30) Foreign Application Priority Data

Aug. 28, 2003 (JP) ..... 2003/303801

(51) Int. Cl.[7] ..... H01H 51/22
(52) U.S. Cl. ..... 335/78; 335/83
(58) Field of Search ..... 335/78–86

(56) References Cited

U.S. PATENT DOCUMENTS 6,781,490 B2 * 8/2004 Funayama et al. ..... 335/78

FOREIGN PATENT DOCUMENTS

JP 2003-37995 A 2/2003

* cited by examiner

*Primary Examiner*—Ramon M. Barrera
(74) *Attorney, Agent, or Firm*—Frishauf, Holtz, Goodman & Chick, P.C.

(57) ABSTRACT

An electromagnetic relay has three fixed contact terminal assemblies arrayed in a row at regular intervals, and a movable contact spring assembly having three movable contacts. An armature is caused to swing by turning on and off an exciting current to a coil assembly so that normally-open contact portions are closed and opened. A movable spring of the movable contact spring assembly is branched into three portions on one end side thereof and a substantially U-shaped slit is formed in each of the branched portions so that spring flexible portions and a current-carrying path portion are separately formed in each branched portion. A current-carrying plate is joined to the three current-carrying path portions so that the three movable contacts are electrically connected together.

10 Claims, 4 Drawing Sheets

MINIATURIZABLE ELECTROMAGNETIC RELAY

This application claims priority to prior Japanese patent application JP 2003-303801, the disclosure of which is incorporated herein by reference.

BACKGROUND OF THE INVENTION

This invention relates to an electromagnetic relay and, in particular, relates to an electromagnetic relay suitable for controlling a three-phase motor adapted to be mounted on an automobile.

In recent years, automotive power steering has been shifting from the hydraulic type to the electric type for the purpose of improvement in fuel consumption. Most electric power steering systems are of a DC motor driven type, but those of a three-phase motor driven type have been increasing following the application thereof to large-displacement vehicles. In case of the electric power steering system driven by the three-phase motor, a switch is required for simultaneously controlling the three phases. For example, an electromagnetic relay is useful which simultaneously controls the three phases at the neutral point (joining point) of the star connection for controlling the three-phase motor. In this case, the electromagnetic relay of this type is required to have high current-carrying performance and high interruption performance, and is further required to be small in size.

Conventionally, the control of the three-phase motor has been carried out by the following first or second method. In the first method, use is made of a plurality of electromagnetic relays each having a pair of a movable contact portion and a fixed contact terminal. A movable spring is used for forming the movable contact portion such that the movable spring is provided with a movable contact and an extraction terminal. Further, the plurality of electromagnetic relays are mounted on a circuit board. In the second method, a three-phase control electromagnetic relay is used. The three-phase control electromagnetic relay comprises two fixed contact terminals each having a fixed contact, and two movable contact portions for simultaneously shorting the two fixed contact terminals. A movable spring is used for forming the two movable contact portions such that the movable spring is provided with two movable contacts and one extraction terminal. A three-phase control is performed by the use of the three terminals, i.e. the extraction terminal and the two fixed contact terminals. Note that each of the fixed contact terminals of the electromagnetic relays used in the first and second methods is produced by processing a plate-like base member.

In the first method, inasmuch as the plurality of electromagnetic relays are used, the electromagnetic relays account for the large ratio on the circuit board. This goes against customers' requests for saving as much space as possible.

On the other hand, in case of the electromagnetic relay used in the second method, a difference exists in conductor resistance values between the two fixed contact terminals and between one of the two fixed contact terminals and the extraction terminal so that values of the current flowing between the three terminals differ from each other during on-operation of the electromagnetic relay. Further, when it is necessary to increase the current-carrying capacity, the fixed contact terminal should be increased in sectional area thereof. However, inasmuch as the fixed contact terminal has the plate-like shape, it can not be efficiently arranged on a base, which precludes reduction in size of the electromagnetic relay.

Moreover, in order to decrease a conductor resistance value from the movable contact to the extraction terminal via the movable spring in each of the electromagnetic relays used in the first and second methods, there is no alternative but to increase the sectional area of the movable spring. However, the movable spring is subjected to a restriction in terms of a required spring constant, and therefore, the sectional area thereof is limited in size in this regard.

SUMMARY OF THE INVENTION

It is therefore an object of this invention to provide a three-phase control electromagnetic relay that is small in size and excellent in current-carrying performance and interruption performance.

An electromagnetic relay according to this invention comprises a core with a coil wound around the core, a substantially L-shaped yoke fixed to the core on one end side thereof, an armature disposed so as to confront the core on the other end side thereof, and adapted to be attracted to the core when the core is excited, and a hinge spring swingably supporting the armature. The electromagnetic relay further comprises a movable spring made of a conductive material, having three or more movable contacts, and coupled to the armature so as to be movable in response to swinging motion of the armature, and fixed terminals having as many fixed contacts as the number of the movable contacts.

According to one aspect of this invention, the movable contacts are arrayed at regular intervals at one end portion of the movable spring on a side remote from a supporting portion of the armature by the hinge spring. The fixed contacts are disposed at positions confronting the movable contacts, respectively. With this configuration, in the electromagnetic relay, the movable contacts and the fixed contacts are substantially simultaneously opened and closed in response to the swinging motion of the armature.

When the number of the movable contacts is three, the movable spring is branched into three portions at the one end portion thereof. Each of the branched portions is formed with a substantially U-shaped slit arranged in parallel to a longitudinal direction of the branched portion so that spring flexible portions are formed on both sides of the slit and a current-carrying path portion is formed inward of the slit. The movable contacts are attached to the branched portions at forward ends thereof, respectively. A current-carrying plate made of a conductive material is joined to the three current-carrying path portions so that the three movable contacts are connected together via the current-carrying plate.

It is preferable that the electromagnetic relay be provided with a base mounted with the foregoing respective components thereon. It is preferable that the fixed terminals each have a cylindrical shape and be mounted on the base so as to be arrayed at regular intervals.

When the number of the fixed terminals is three, it is preferable that each of the three fixed terminals comprises a cylindrical trunk portion attached with the fixed contact, and a cylindrical terminal portion mounted on the base. In this case, the terminal portion has a diameter smaller than that of the trunk portion. It is preferable that a ratio between lengths of the trunk portion and the terminal portion of the fixed terminal located at the middle among the three fixed terminals be set different from a ratio between lengths of the trunk portion and the terminal portion of each of the other fixed terminals.

DESCRIPTION OF THE PREFERRED EMBODIMENT

Figure 1:
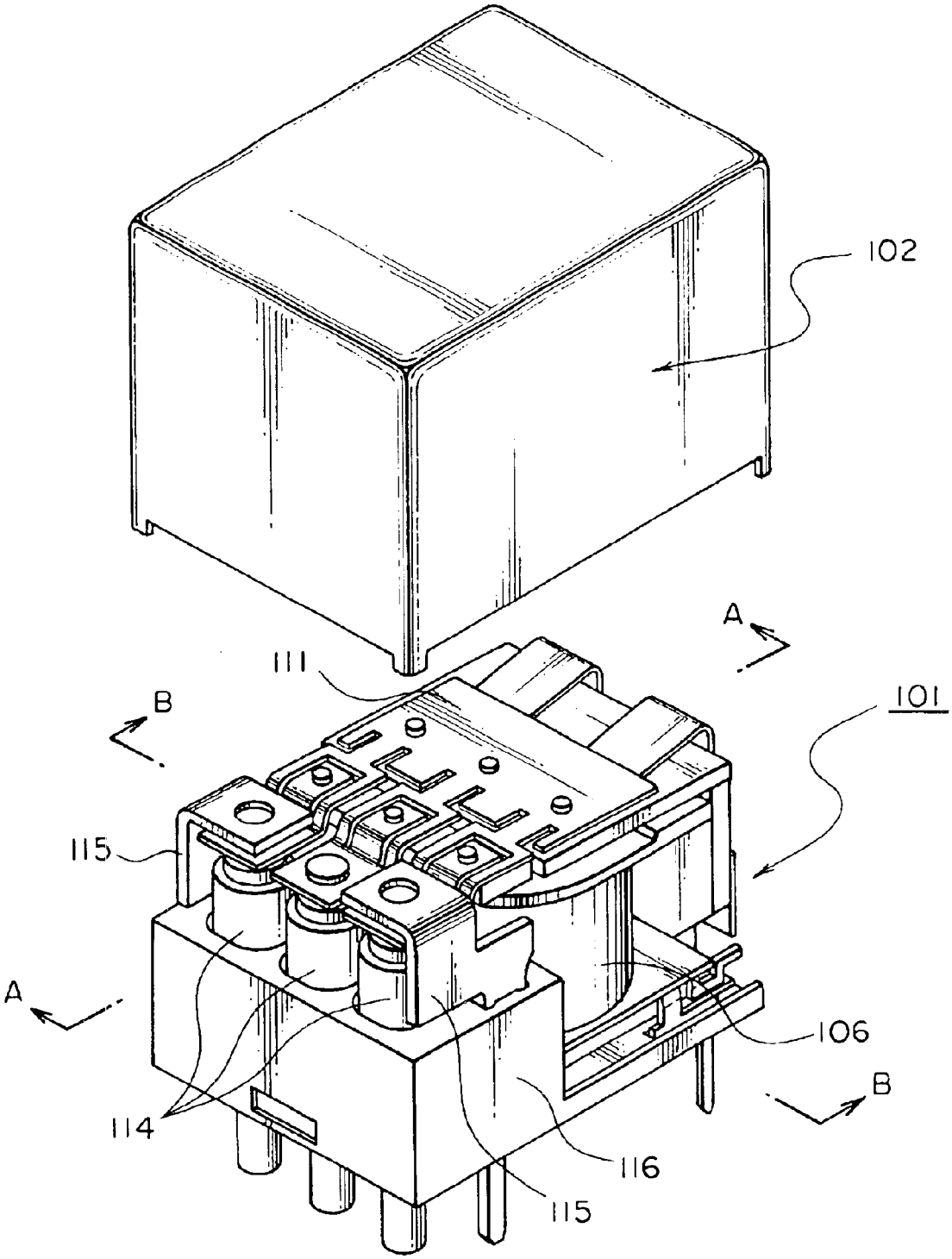
FIG. 1 is a perspective view of an electromagnetic relay according to a preferred embodiment of this invention.
Figure 2:
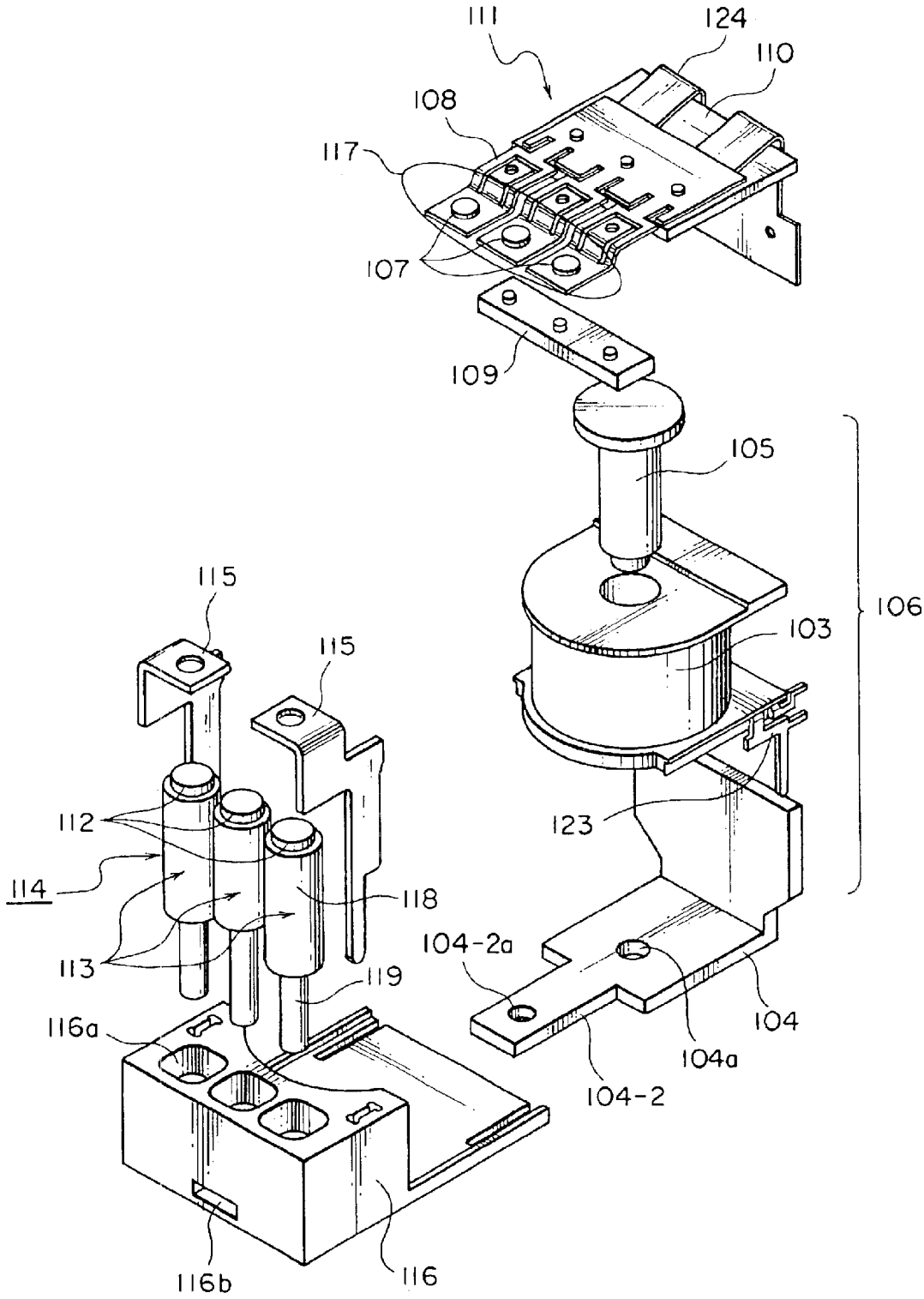
FIG. 2 is an exploded perspective view of the electromagnetic relay illustrated in FIG. 1.

Referring to FIGS. 1 to 5, description will be made of an electromagnetic relay according to a preferred embodiment of this invention. FIG. 1 is a perspective view of the electromagnetic relay, and FIG. 2 is an exploded perspective view of the electromagnetic relay illustrated in FIG. 1.

In FIG. 1, the electromagnetic relay in this embodiment comprises an electromagnetic relay body 101 and a cover 102 for covering it. The electromagnetic relay body 101 comprises a magnet assembly 106, a movable contact spring assembly 111, three fixed contact terminal assemblies 114, two backstop terminals 115, and a resin base 116 for mounting the foregoing respective components thereon.

In FIG. 2, the magnet assembly 106 comprises a coil assembly 103, a substantially L-shaped yoke 104, a core 105, and two coil terminals 123 (only one is illustrated) attached to the coil assembly 103. The movable contact spring assembly 111 comprises a movable spring 108, three movable contacts 107 arranged side by side on one end side of the movable spring 108, a rectangular current-carrying plate 109 fixed to the movable spring 108 on its lower side, and an armature 110. Each fixed contact terminal assembly 114 comprises a fixed contact 112 and a fixed terminal 113. The fixed contact 112 is provided at an upper end of the fixed terminal 113. The base 116 is formed with three holes 116*a* arrayed in a row at regular intervals. The three fixed contact terminal assemblies 114 are press-fitted into the holes 116*a* of the base 116, respectively. The fixed terminal 113 has a cylindrical trunk portion 118 and a cylindrical terminal portion 119. The trunk portion 118 has an increased diameter for ensuring high current-carrying performance, while the terminal portion 119 has a decreased diameter in terms of coupling to a circuit board (not illustrated). In addition, the fixed terminal 113 may be formed so as to have a square trunk portion and a square terminal portion.

Figure 3:
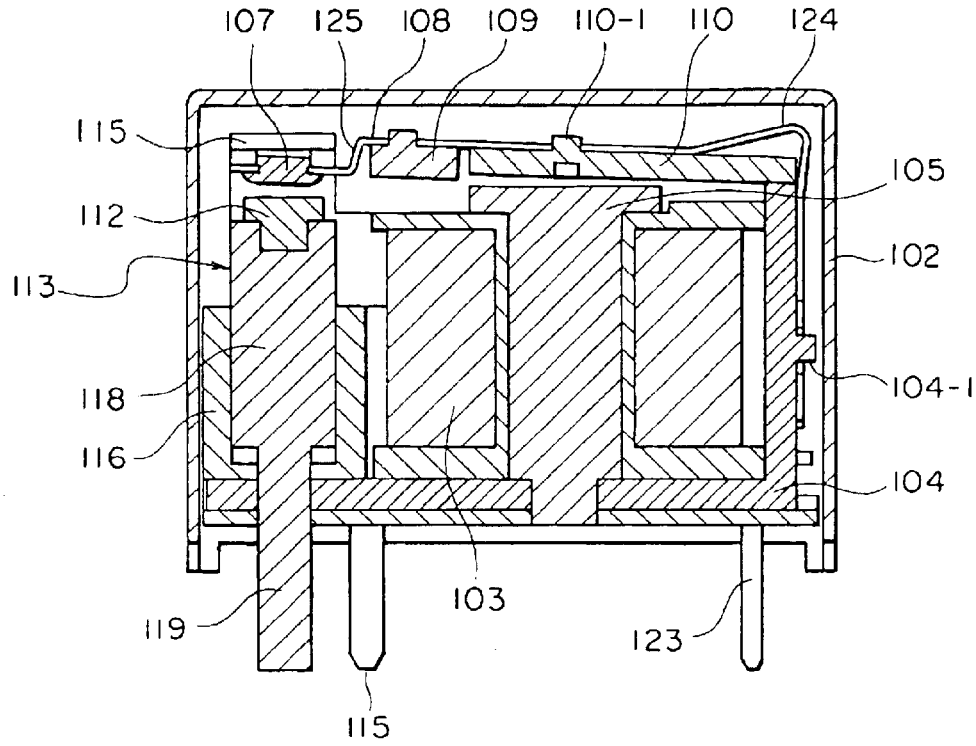
FIG. 3 is a sectional view taken along line A—A in FIG. 1.
Figure 4:
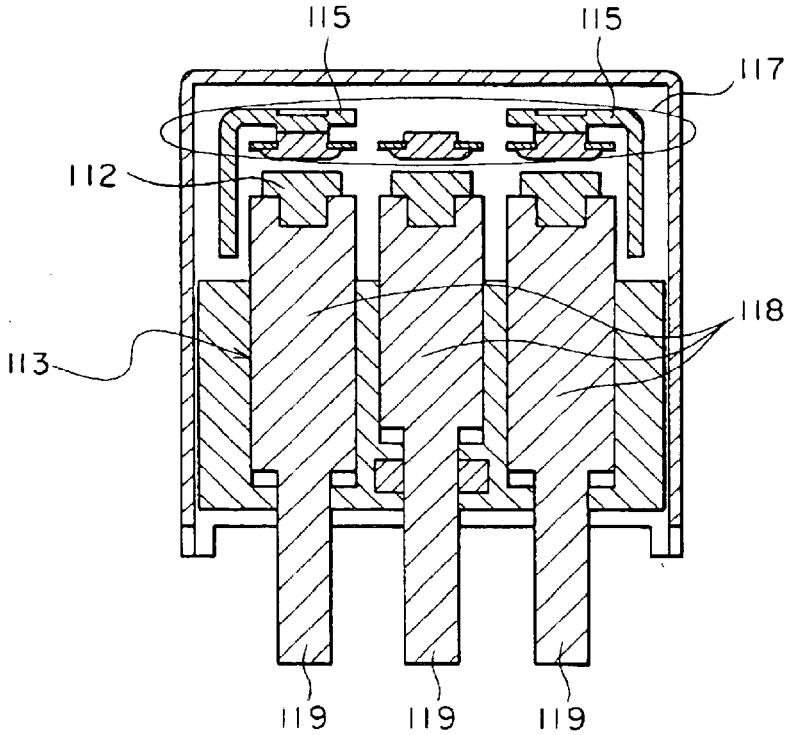
FIG. 4 is a sectional view taken along line B—B in FIG. 1.

Referring also to FIGS. 3 and 4, among the three fixed contact terminal assemblies 114, the trunk portion 118 and the terminal portion 119 of the middle fixed contact terminal assembly 114 are set to have lengths that differ from those of the trunk portion 118 and the terminal portion 119 of each of the fixed contact terminal assemblies 114 on both sides. Specifically, the length of the trunk portion 118 of the middle fixed contact terminal assembly 114 is set smaller than that of the trunk portion 118 of each of the both-side fixed contact terminal assemblies 114. On the other hand, the length of the terminal portion 119 of the middle fixed contact terminal assembly 114 is set greater than that of the terminal portion 119 of each of the both-side fixed contact terminal assemblies 114. With this configuration, a resistance value between the both-side fixed terminals 113 and a resistance value between the middle fixed terminal 113 and one of the both-side fixed terminals 113 can be set equal to each other during on-operation of the electromagnetic relay. This is because such a configuration makes it possible to correct a difference in resistance values caused by a difference in paths of the current flowing through the current-carrying plate 109 during on-operation of the electromagnetic relay.

The movable contact spring assembly 111 has on its one end side a movable contact portion 117 confronting the fixed contacts 112 of the three fixed contact terminal assemblies 114. The armature 110 is combined with a hinge spring 124 so that the armature 110 is caused to swing due to electromagnetic forces generated by turning on and off an exciting current to the coil assembly 103. The hinge spring 124 is fixed by fitting engagement with a plurality of projections 104-1 formed on the yoke 104. In this embodiment, the hinge spring 124 is formed integral with the movable spring 108. However, the hinge spring 124 may be formed separately from the movable spring 108 and then fixed to the movable spring 108. The movable spring 108 is made of a conductive material and fixed by fitting engagement with three projections 110-1 formed on the armature 110. More specifically, the movable spring 108 is fixedly joined to the armature 110 at three points arrayed in a direction substantially perpendicular to a direction oriented toward the movable contacts 107 from the hinge spring 124. Particularly, it is preferable that those three points be respectively located on extensions of the center lines in a longitudinal direction of branched portions which will be described hereinbelow.

Figure 5:
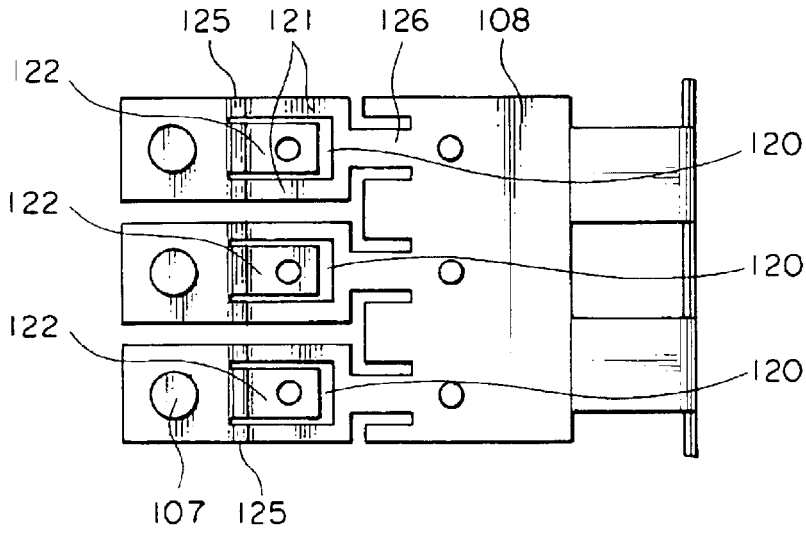
FIG. 5 is a plan view of a movable spring and a hinge spring illustrated in FIG. 2.

Referring further to FIG. 5, the movable spring 108 is branched into three portions on its one end side. Each of the branched portions is provided with the movable contact 107 at its forward end. Each branched portion is further formed with a substantially U-shaped slit 120. The slit 120 is arranged in parallel to the longitudinal direction of the branched portion with a bottom portion of the U-shape facing toward the other end side of the movable spring 108. With this configuration, each branched portion has spring flexible portions 121 formed on both sides of the slit 120, respectively, and has a current-carrying path portion 122 formed inward of the slit 120. The current-carrying plate 109 (see FIG. 2) is joined to the three current-carrying path portions 122 on their lower sides. In this case, current that flows between the two movable contacts 107 through the spring flexible portions 121 is only a little as compared to current that flows therebetween through the current-carrying plate 109, and therefore, the spring flexible portions 121 serve mainly as springs. On the other hand, the current-carrying path portions 122 serve to pass the main current therethrough which flows through the current-carrying plate 109. A constriction or narrower portion 126 of each branched portion is configured to have a width smaller than that of the remainder of the branched portion so that the spring constant at each branched portion can be set to a proper value.

Referring back to FIG. 3, the armature 110 is coupled to the yoke 104 by the hinge spring 124 to form a magnetic circuit cooperatively with the core 105. More specifically, the armature 110 is coupled to an upper end of the yoke 104 and held by the hinge spring 124 so as to be swingable using this upper end as a fulcrum. Each branched portion of the movable spring 108 is bent to form a step at a bending portion 125 close to the current-carrying plate 109, and is attached with the movable contact 107 at the forward end thereof. Each of the bending portion 125 has two slits connected to top portions of U-shaped slit 120.

The L-shaped yoke 104 has a plate-like portion mounted on the base 116. This plate-like portion is formed with a hole 104*a* receiving a lower end portion of the core 105 mounted therein. The plate-like portion of the yoke 104 also has a wedge-shaped portion 104-2 extending to one end of the base 116. The wedge-shaped portion 104-2 is inserted into a hole 116*b* formed in the base 116. To this end, the wedge-shaped portion 104-2 is formed with a hole 104-2*a* into which the middle terminal portion 119 is press-fitted. Such a shape of the yoke 104 not only serves to firmly fix the yoke 104 or the magnet assembly 106 to the base 116, but also contributes to improvement in heat dissipation effect by increasing the surface area of the yoke 104, apart from the formation of the magnetic circuit.

Note that FIG. 3 illustrates one of the two coil terminals 123 and one of the two backstop terminals 115.

The two backstop terminals 115 are fixed at positions on both sides of the base 116 and close to the both-side fixed contact terminal assemblies 114 among the three fixed contact terminal assemblies 114. The backstop terminals 115 serve to stop upward movement of the movable contact spring assembly 111 at a prescribed position when the exciting current to the coil assembly 103 is turned off, and further serve as open/close terminals for monitoring the basic characteristic of the electromagnetic relay.

Figure 6:
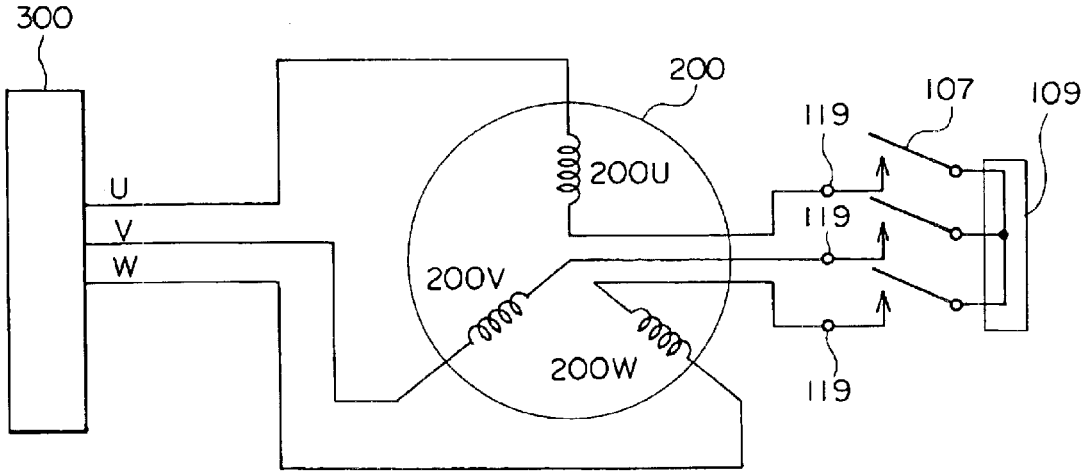
FIG. 6 is a circuit diagram for describing one example of an application mode of the electromagnetic relay illustrated in FIG. 1.

Referring to FIG. 6, description will be given about one example of an application mode of the electromagnetic relay according to the embodiment of this invention. FIG. 6 illustrates the example wherein the electromagnetic relay according to the embodiment of this invention is used for controlling a three-phase motor 200 in star connection. The three-phase motor 200 comprises a U-phase coil 200U, a V-phase coil 200V, and a W-phase coil 200W each having one end connected to a controller 300. In the star connection, the U-phase coil 200U, the V-phase coil 200V, and the W-phase coil 200W are commonly connected together at their other ends. However, in this example, the U-phase coil 200U, the V-phase coil 200V, and the W-phase coil 200W are individually connected to the three terminal portions 119 of the electromagnetic relay at their other ends. With this connection manner, when the electromagnetic relay is turned on, the U-phase coil 200U, the V-phase coil 200V, and the W-phase coil 200W are connected to the controller 300 substantially simultaneously.

Now, description will be given about one example of materials of the respective components of the electromagnetic relay according to the embodiment of this invention. Use is made of beryllium copper for the movable spring 108, a silver-based alloy for the movable contacts 107 and the fixed contacts 112, and soft magnetic iron for the yoke 104, the core 105, and the armature 110. However, these materials are only one example, and the materials of the components are not limited thereto.

The electromagnetic relay according to the embodiment of this invention can be formed to have an outer size of 20×15×15 mm or less with an inter-terminal resistance of 1 mΩ or less and a continuous current-carrying capacity of 100A for 120 seconds.

In the foregoing embodiment of this invention, the electromagnetic relay is of the type that simultaneously turns on and off the three circuits. However, it may also be configured such that a forward end portion of a movable spring is branched into four portions and movable contacts attached to the respective branched portions are connected together by a current-carrying plate. In this case, it is possible to achieve an electromagnetic relay that simultaneously turns on and off six circuits at maximum and that is excellent both in conductivity between the movable contacts and in spring flexibility supporting the movable contacts like in case of the three circuits.

According to the electromagnetic relay of the foregoing embodiment of this invention, by arraying the plurality of fixed contact terminal assemblies in a row at regular intervals, the inter-terminal conductor resistances caused by the respective combinations thereof can be set equal to each other. Specifically, since the current path length through one of the outer fixed terminals—the movable contact portion—the other outer fixed terminal becomes longer than the current path length through the outer fixed terminal—the movable contact portion—the middle fixed terminal, so that there occurs a difference in inter-terminal conductor resistance. However, the inter-terminal conductor resistances can be made equal to each other by decreasing the length or diameter of the trunk portion of the middle fixed contact terminal assembly among the aligned fixed contact terminal assemblies. Then, since the three fixed contact terminal assemblies are electrically connected or disconnected simultaneously by swinging motion of the movable contact spring assembly, the obtained electromagnetic relay well serves to control the three-phase motor.

Further, by forming each of the fixed terminals into the cylindrical shape, it is possible to efficiently arrange them on the base while the increased sectional area of the terminal is ensured, and therefore, the current-carrying capacity can be improved as compared to the electromagnetic relay having the same outer size.

Assuming that such an electromagnetic relay is configured like the conventional electromagnetic relay, it is necessary to configure it as follows. Specifically, in order to increase the current-carrying capacity between the terminals, it is necessary to increase the sectional area of the movable spring serving to short the three fixed contact terminal assemblies and reduce as much as possible the length over which the current flows. Further, the three branched portions of the movable spring are required to have independency from each other to such a degree that can allow the assembly accuracy of the three normally-open contact portions. In this case, the sectional area of the movable spring should be decreased while the length thereof should be increased, which goes against improvement in current-carrying performance.

On the other hand, in the foregoing embodiment of this invention, the three branched portions of the movable spring are respectively formed with the substantially U-shaped slits so as to provide the spring flexible portions and the current-carrying path portions, and the current-carrying plate having a large conductivity is joined to the three current-carrying path portions. As a result, each of the spring flexible portions can be reduced in sectional area and spring length. Consequently, each of the three branched portions can be reduced in spring constant while increased in independency, and each of the current-carrying path portions can be increased in sectional area while shortened in current-carrying path length so that the current-carrying performance can be improved.

Further, in the foregoing embodiment of this invention, two contact gaps of the electromagnetic relay exist in series with respect to a circuit of each phase of the three-phase circuits. Accordingly, inasmuch as the contact gap becomes twice with the electromagnetic relay of the same size, the interruption performance can be enhanced. Further, it is advantageous in terms of long-term reliability.

While this invention has thus far been described in conjunction with the preferred embodiment thereof, it will be readily possible for those skilled in the art to put this invention into practice in various other manners without departing from the scope of this invention.

What is claimed is:

1. An electromagnetic relay comprising:

a core with a coil wound around said core;

a substantially L-shaped yoke fixed to said core on one end side thereof;

an armature disposed so as to confront said core on the other end side thereof, said armature adapted to be attracted to said core when said core is excited;

a hinge spring swingably supporting said armature;

a movable spring made of a conductive material and having three or more movable contacts, said movable spring coupled to said armature so as to be movable in response to swinging motion of said armature; and fixed terminals having as many fixed contacts as the number of said movable contacts, wherein said movable contacts are arrayed at regular intervals at one end portion of said movable spring on a side remote from a supporting portion of said armature by said hinge spring, said fixed contacts are disposed at positions confronting said movable contacts, respectively, and said movable contacts and said fixed contacts are substantially simultaneously opened and closed in response to the swinging motion of said armature.

2. An electromagnetic relay according to claim 1, wherein:

the number of said movable contacts is three, said movable spring is branched into three portions at the one end portion thereof, each of the branched portions is formed with a substantially U-shaped slit arranged in parallel to a longitudinal direction of the branched portion so that spring flexible portions are formed on both sides of said slit and a current-carrying path portion is formed inward of said slit, said movable contacts are attached to said branched portions at forward ends thereof, respectively, and a current-carrying plate made of a conductive material is joined to said three current-carrying path portions so that said three movable contacts are connected together via said current-carrying plate.

3. An electromagnetic relay according to claim 1, further comprising a base mounted with said respective components thereon, wherein said fixed terminals each have a cylindrical shape and are mounted on said base so as to be arrayed at regular intervals.

4. An electromagnetic relay according to claim 3, wherein:

the number of said fixed terminals is three, each of said three fixed terminals comprises a cylindrical trunk portion attached with said fixed contact, and a cylindrical terminal portion mounted on said base, said terminal portion has a diameter smaller than that of said trunk portion, and a ratio between lengths of said trunk portion and said terminal portion of the fixed terminal located at the middle among said three fixed terminals is set different from a ratio between lengths of said trunk portion and said terminal portion of each of the other fixed terminals.

5. An electromagnetic relay according to claim 2, wherein:

each of said branched portions has a bending portion which is bent to form a step at a position close to said current-carrying plate.

6. An electromagnetic relay according to claim 5, wherein:

said bending portion has two slits connected to top portions of said U-shaped slit.

7. An electromagnetic relay according to claim 5, wherein:

each of said branched portions has a constriction portion having a width smaller than that of the remainder of said branched portion.

8. An electromagnetic relay according to claim 2, wherein:

said movable spring is fixedly joined to said armature at three points arrayed in a direction substantially perpendicular to a direction oriented toward said movable contacts from said hinge spring and said three points are respectively located on extensions of the center lines in a longitudinal direction of said three branched portions.

9. An electromagnetic relay according to claim 3, wherein:

two backstop terminals are fixed at positions on both sides of said base and close to both sides of said three fixed terminals to restrict the upward movement of said movable contacts.

10. An electromagnetic relay according to claim 3, wherein:

said L-shaped yoke has a plate-like portion mounted on said base, said plate-like portion having a wedge-shaped portion extending to one end of said base, said wedge-shaped portion being inserted into a hole formed in said base.

* * * * *